United States Patent [19]

Jirasco et al.

[11] Patent Number: 4,781,332

[45] Date of Patent: Nov. 1, 1988

[54] METHOD OF WINDING CONICAL OR TAPERED BOBBIN AND DEVICE TO PERFORM SAID METHOD

[75] Inventors: Petr Jirasco; Zdenek Koloc, both of Liberec; Vaclay Moc, Turnov; Miroslav Vaclavik, Liberec, all of Czechoslovakia

[73] Assignee: Elitex, Koncern Textilniho Strojirenstvi, Liberec, Czechoslovakia

[21] Appl. No.: 810,977

[22] Filed: Dec. 19, 1985

[30] Foreign Application Priority Data

Dec. 19, 1984 [CS] Czechoslovakia ..... 9982-84

[51] Int. Cl.[4] ..... B65H 54/42

[52] U.S. Cl. ..... 242/18 DD; 242/43 R; 242/45

[58] Field of Search ..... 242/18 DD, 18 CS, 18 R, 242/43 R, 45

[56] References Cited

U.S. PATENT DOCUMENTS 4,089,480 5/1978 Kamp ..... 242/18 DD

*Primary Examiner*—Stanley N. Gilreath

*Attorney, Agent, or Firm*—Klein & Vibber

[57] ABSTRACT

Method of and apparatus for winding conical or tapered bobbins with the use of a rotating transfer element rolling under the surface of the bobbin on a rotating support element which compensate for the differences in the winding and supply speeds of the thread. The part of the thread leading from the distributor of the thread to the supply point of the thread onto the bobbin is lead onto the surface of a rotating transfer element which is in engagement with the surface of the winding on the bobbin and is angularly positioned on the support element in accordance with the direction of said part of the thread.

5 Claims, 1 Drawing Sheet

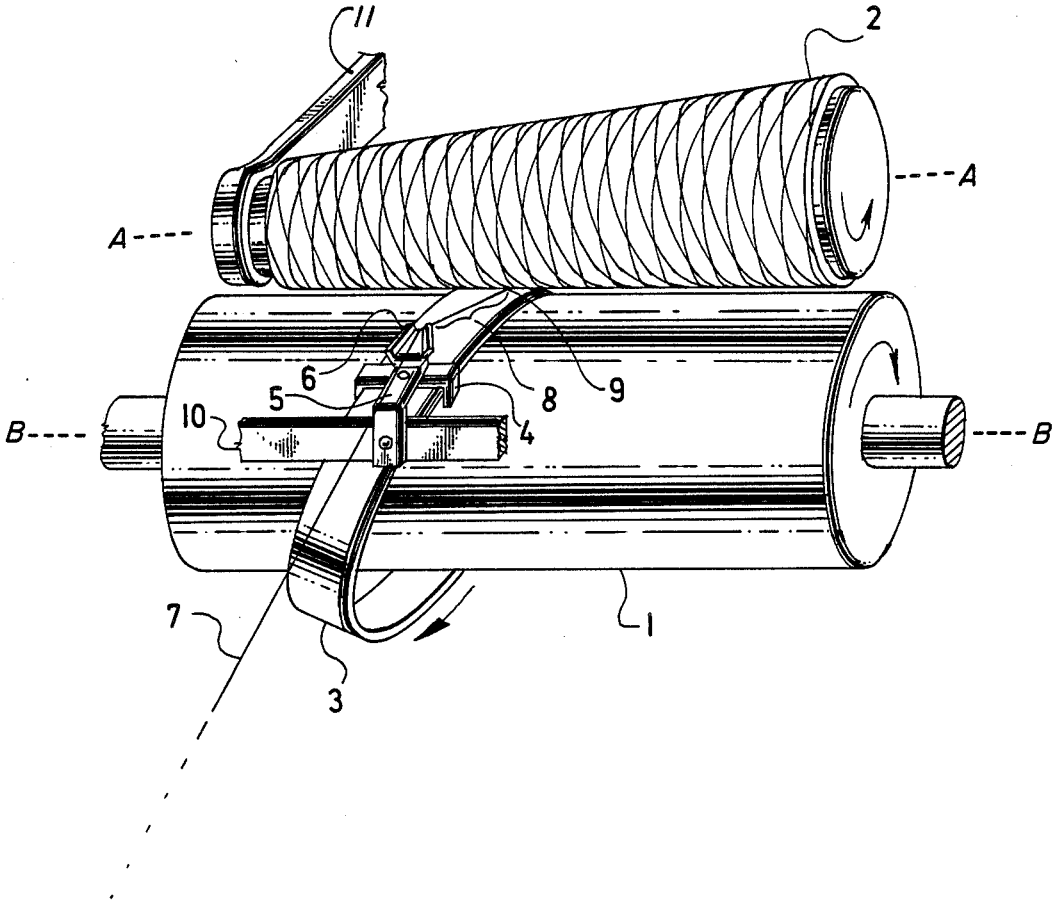
11
2
A
A
6
5
8
9
10
4
B
B
7
1
3

METHOD OF WINDING CONICAL OR TAPERED BOBBIN AND DEVICE TO PERFORM SAID METHOD

This invention relates to a method of and an apparatus for the winding of conical or tapered bobbins especially in textile machines having a constant supply speed of the thread being wound.

In the winding of conical or tapered bobbins in textile machines being a constant supply speed of the thread being wound, known systems for performing said winding must respond to the changing diameter of the bobbin if constant tension in the thread being wound is to be maintained. Machines created for and employed for performing such method are provided with various compensators, mechanical with swinging rollers, spring type or air type, which balance the differences in winding and supply speed of the thread, while the compensators are usually combined with the modification of a smooth driving roller of the bobbin. Such modification constists in the creation of an arrow band of the so-called increased frictional contact zone on said cylinder, for example, by grooving, adhesive coating, the provision of stripes, etc.

Such compensators, however, do not secure a perfect structure of the bobbin winding; they are relatively quite complicated, they ask for a very particular maintenance and adjustment, and they are acceptable only for a limited range of conical bobbins. Moreover, the zone of increased friction created on a smooth driving roller causes undesirable traces on the winding on the bobbin.

Further known prior art devices are designed with such an arrangement of the bobbin drive that said bobbin is driven in the place where the thread being wound is supplied to it, because then the dependence of the thread tension on changing bobbin diameter can be omitted and compensators for variations in thread tension are, therefore, not necessary.

One of the known devices of said last named type includes a belt which is wound around the smooth driving rotor and tensioned by a roller in a plane normal to the axis of said smooth driving rotor. The smooth driving rotor does not actually drive the bobbin; it is only a support element for the bobbin, while said belt directly drives the bobbin due to its frictional contact with a respective part of the winding on the bobbin. The contact of the belt with the surface of the winding is the location of feeding of the thread onto the bobbin. For this reason, the belt is axially moved by a tensioning roller together with the thread distributor on the holder of which the tension roller is mounted. The result is a reciprocatory axial movement of the wound-around belt part over the support element; however, during said movement, the belt is considerably deformed so that the necessary condition of conformity of the circumferential speed of the belt with the speed of supply of the thread to the bobbin is not maintained, nor is the desired mutually equal circumferential speed of all three bodies, i.e. surface of the bobbin, the belt, and the support element directly in the zone of supply of the thread onto the bobbin. Moreover, the device is disadvantageous especially in that the relative movement of the belt along the length of the bobbin causes failure in thread winding, and the service life of the belt is short.

The above-mentioned disadvantages of known systems for winding conical or tapered bobbins are eliminated by a method of and the apparatus for winding according to the present invention. In accordance with the invention, the part of the thread leading from the thread distributor to the supply point on the bobbin is disposed on the surface of the rotating transfer element which is angularly adjusted under the surface of the bobbin on a support element so as to lie in the direction of said part of the thread.

The effect of said method of and apparatus for thread winding is based first of all on the fact that the thread supplied to the supply point on the bobbin is precisely laid by the rotating transfer element, the neighboring already wound turns of the thread on the bobbin are not damaged, and what is decisive is that in the place of mutual contact, that is, the place of thread winding at the supply point, the rotating transfer element and the support element have equal speed, while said speed, expressed in vector form is normal to the axis of rotation of the support element in all of the diverse positions which the rotating transfer element can assume so that there is a relative rest in the place of momentary contact of the rotating transfer element with the surface of the winding on the bobbin. This creates the basic conditions for the winding of conical or tapered bobbins in accordance with the present invention.

Further effects and advantages of a preferred solution according to the invention are evident from the following description and from the accompanying drawing.

The single FIGURE of the drawing is a schematic view in perspective illustrating the arrangement of the rotating transfer element as it is freely suspended from the support element for the bobbin being wound.

In the illustrative embodiment of the apparatus of the invention, there is provided a known rotating supporting element 1 in the form of a circular cylindrical rotary body, for example, in the form of a smooth roller which supports a frusto conical bobbin 2. Bobbin 2 is supported on a swing arm 11 and is pressed downwardly by the weight of the bobbin, its winding, and the arm 11. As shown, the axis A—A of the bobbin 2 is disposed at an angle with respect to the axis B—B of element 1, the angle between the axes being such that the lower surface of the winding on the bobbin 2 is parallel to the upper confronting surface of the element 1. The said rotating supporting element 1 does not directly drive the bobbin 2. The direct drive of the bobbin is by a further rotating transfer element 3 in the shape of a ring or belt which is freely suspended from the rotating support element 1 and which is set in rotary motion by friction on the surface of the support element 1 and by the pressure upon it by the bobbin 2. The rotating transfer element 3 has an interior circumference which is somewhat larger than that of the rotating support surface 1. The lateral position of the transfer element 3 is controlled by a guide 4 disposed on the holder 5 of a distributor 6 for the thread 7. The guide 4 is mounted stationary on the holder 5. The spacing between the bent ends of the guide 4 is larger than the width of the rotating transfer element 3. Thus, the rotating element is guided to the rotating support element 1. The holder 5 is connected with a rod 10 which is centrally controlled by a mechanism, which is not here shown. The mechanism for controlling the rod 10 causes it to reciprocate in a path which is generally equal to the effective length of the bobbin 2. Such reciprocation may be effected, for example, by a cam driven in synchronism with the element 1, and by a cam follower mounted upon the rod 10 so as to drive the rod with a reciprocating rotary motion.

The fact that the internal circumference of the rotating transfer element 3 is larger than the circumference of the rotating support element 1 enables the transfer element to be angularly adjustable on said rotating support element 1 at least in the direction of a part 8 of the thread 7 to the point 9 at which the thread 7 first engages the bobbin 2, while the contact of both patties, that is, of the rotating support element 1 and the rotating transfer element 3 in the zone of the supply point 9 for the thread 7 is practically a straight line. There is also a straight line contact at the surface 2 of the bobbin with a rotating transfer element 3, while said theoretical straight line contact is parallel to the longitudinal axis of the rotating support element 1.

MANNER OF OPERATION OF THE INVENTION

The method of and apparatus for performing such method of the invention operates as follows:

Upon winding a conical or tapered bobbin, the distributor 6 for the thread periodically moves along the rotating support element 1. In the dead points, that is, the points of reversal of travel of the distributor at the ends of the bobbin, the distributor 6 angularly deflects the freely suspended rotating transfer element 3 by means of the guide 4 into the direction of the part 8 of the thread 7, the part 8, as we have seen, extends from the distributor 6 to the supply point 9 of the thread onto the bobbin 2. After the angularly positioning of the rotating transfer element 3 at either of said dead points, the rotating transfer element 3 retains its inclined position on the rotating support element 1 within the entire time of its movement to the second end of the bobbin 2, whereby the change of the direction of motion of the distributor 6, the rotating transfer element 3 is again angularly positioned by means of the guide 4 under the surface of the bobbin 2 in the second direction, the direction of the part 8 of the thread 7 in its approach to the supply point 9 on the bobbin 2 being simultaneously changed.

The part 8 of the thread 7 is, therefore, continuously led to the supply point 9 on the bobbin 2 over the surface of a rotating transfer element 3, which in this zone of the bobbin 2 secures its repetitive circumferential speed equal to the speed of supply of the thread 8, which is an inevitable condition for the creation of a satisfactory conical or tapered winding on the bobbin 2.

Although the invention is described and illustrated with reference to a plurality of embodiments thereof, it is to be expressly understood that it is in no way limited to the disclosure of such preferred embodiments but is capable of numerous modifications within the scope of the appended claims.

We claim:

1. In a method of winding conical or tapered bobbins, especially in textile machines with constant supply of the thread being wound, including the steps of biasing the surface of the bobbin against a rotating support element, forming the support element as a rotating body, directly driving the bobbin by a rotating transfer element, frictionally engaging the surface of the winding on the bobbin in the zone of the supply point of the thread on the bobbin, frictionally engaging the surface of the support element, and axially reciprocating the transfer element together with a thread distributor, the improvement comprising supplying a part of thread leading from the thread distributor to a supply point on the bobbin onto a surface of the rotating transfer element while said transfer element is in contact with the winding on the bobbin, and angularly positioning said transfer element on the rotating support element into the direction of said part of the thread.

2. Method as claimed in claim 1, further comprising angularly positioning the rotating transfer element in dependence upon the direction of movement of the thread distributor along the bobbin.

3. Method as claimed in claim 1, further comprising angularly positioning the rotating transfer element on the rotating support element automatically at least at one end of the bobbin.

4. In an apparatus for winding conical or tapered bobbins, especially in textile machines with constant supply of the thread being wound, a rotating support element formed as a rotating body for supporting the bobbin by engagement with the surface of a winding on the bobbin, a rotating transfer element in frictional contact with the winding on the bobbin in the zone of a supply point of the thread on the bobbin and in frictional contact with the surface of the support element; and a thread distributor for reciprocally moving the transfer element, the improvement comprising the rotating transfer element encircling said support element and having a larger internal circumference than the circumference of the support element by a value permitting the angular positioning of the transfer element into the direction of the part of the thread leading to the supply point on the bobbin from the thread distributor.

5. Apparatus as claimed in claim 4 further comprising, said thread distributor having a holder and said holder having a guide, wherein the rotating transfer element is formed by a ring freely suspended from the rotating support element and is laterally positioned by said guide.

* * * * *